United States Patent [19]

Vest

[11] 4,111,244

[45] Sep. 5, 1978

[54] EXTENDABLE FUEL DISPENSING NOZZLE

[75] Inventor: Eugene W. Vest, Wappingers Falls, N.Y.

[73] Assignee: Texaco Inc., New York, N.Y.

[21] Appl. No.: 687,855

[22] Filed: May 19, 1976

[51] Int. Cl.[2] ..... B65D 29/02

[52] U.S. Cl. ..... 141/348; 141/392; 222/524

[58] Field of Search ..... 285/302, 404; 403/109, 403/112, 349; 222/522, 524, 525; 141/392, 348, 349, 330; 220/86 R, 86 T; 137/592, 588

[56] References Cited

U.S. PATENT DOCUMENTS 3,566,928 3/1971 Hansel ..... 141/392

3,911,977 10/1975 Berger ..... 141/348

FOREIGN PATENT DOCUMENTS 562,471 10/1932 Fed. Rep. of Germany ..... 222/524

*Primary Examiner*—Houston S. Bell, Jr.
*Attorney, Agent, or Firm*—Thomas H. Whaley; Carl G. Ries; Robert B. Burns

[57] ABSTRACT

A fuel dispensing nozzle capable of sealably engaging a baffled filler pipe during a tank filling operation; a longitudinally slidable sleeve or member carried on the nozzle's discharge tube permits use of the nozzle in tank filler pipes having a deep set baffle, thereby facilitating the introduction of fuel into said tank.

4 Claims, 4 Drawing Figures

EXTENDABLE FUEL DISPENSING NOZZLE

BACKGROUND OF THE INVENTION

Toward improving the condition of the nation's environment, industry as well as the government, have exerted great efforts. One such effort provides that during the transfer of volatile liquids such as gasoline, adequate means be utilized for confining vapors which would otherwise enter and adversely affect the atmosphere.

In the instance of ordinary fuel transfer stations as for boats or automobiles, closed fuel systems have been devised. These in effect assure that during fuel flow there be no vented opening between the storage tank and the vehicle tank whereby vaporized gasoline or other fuel can pass into the atmosphere.

A key part of such systems is generally the nozzle which is removable to and from the vehicle tank. Said nozzles include a resilient or pliable sealing member. Thus, the nozzle when placed in position for a fuel transfer operation, becomes tightly sealed to the tank filler tube, thereby confining the exiting fumes.

During the filling operation, the fumes can be led away and either confined or condensed into liquid. It is both convenient and safe to conduct the fumes directly through the fuel transfer nozzle, and thence into an underground storage means either for holding the fumes or for passing them into stored liquid fuel.

Another aspect toward effectuating the desire to improve the condition of the environment resides in the use of lead-free gasoline in automotive fuels. Many automotive engines are designed to utilize only lead-free gasoline. Such engines are protected by the provision of a means in the engine fuel that permits only the insertion of a particular nozzle configuration which conducts lead-free fuel.

More specifically, the tank filler tube is provided with a transversely positioned baffle spaced down into the filler pipe. The baffle is further provided with an aperture sufficiently small to accommodate only a nozzle of limited size. The aperture is normally closed with a spring-loaded cover which is forced out of the way when the nozzle penetrates the aperture for a fueling operation.

When a larger size nozzle is inserted into the filler pipe, it will be unable to register in the baffle aperture. Thus, discharging of the fuel upstream of the baffle plate will cause an accumulation. Since the ordinary fuel dispensing nozzle is provided with automatic shut-off means, in response to such rise in the fuel level within the pipe the fuel flow will be automatically discontinued. Of further note, in many automobile fuel tanks particularly in the instance of late model vehicles, the baffle is positioned deeper into the filler tube than usual.

In the presently disclosed arrangement, a hand operated fuel nozzle is provided which permits the use of a fuel system carrying nonleaded gas, to be used in any form of vehicle filler pipe designed for lead-free gas. More specifically the fuel nozzle is provided with an extendable sleeve or member which can be manually adjusted to either the extended or the retracted position.

In the extended position the sleeve will reach far enough into a tank filler pipe to register with the aperture in the baffle plate. Such positioning obviates the possibility of fuel accumulation at the upper side of the plate prior to the tank actually becoming filled.

It is an object of the invention therefore to provide a seal tight nozzle adapted to operate in conjunction with a tank filler pipe which is designed to receive only lead-free fuel. A further object is to provide a nozzle having an extendable discharge tube operably carried thereon which will permit the nozzle to be used in a greater number of fuel tanks than would ordinarily be possible with a shorter tube.

Toward achieving these objectives, the invention provides in essence a fuel dispensing nozzle adapted for manual operation by being inserted into a fuel tank filler tube which normally received a lead-free gas. The nozzle is sealably, although removably engaged with the tank filler pipe by means of a resilient member which additionally provides passage for vapors which are displaced from the tank during a filling operation.

An extendable sleeve operably carried on the nozzle discharge tube when in the advanced position, loosely registers within the corresponding aperture formed in the filler pipe baffle. The nozzle is thereby properly positioned to accomplish the desired fuel transfer operation.

DESCRIPTION OF THE DRAWINGS

Referring to the drawings, FIG. 1 illustrates a system of the type contemplated embodying a fuel dispensing nozzle 10 which is connected at one end through a fuel conduit 11 to a source of fuel 12. Normally the fuel source can comprise a gasoline filling station pump which, in the usual manner also embodies means for registering the amount of fuel transferred during a particular operation.

Figures 1, 2, 3, 4:
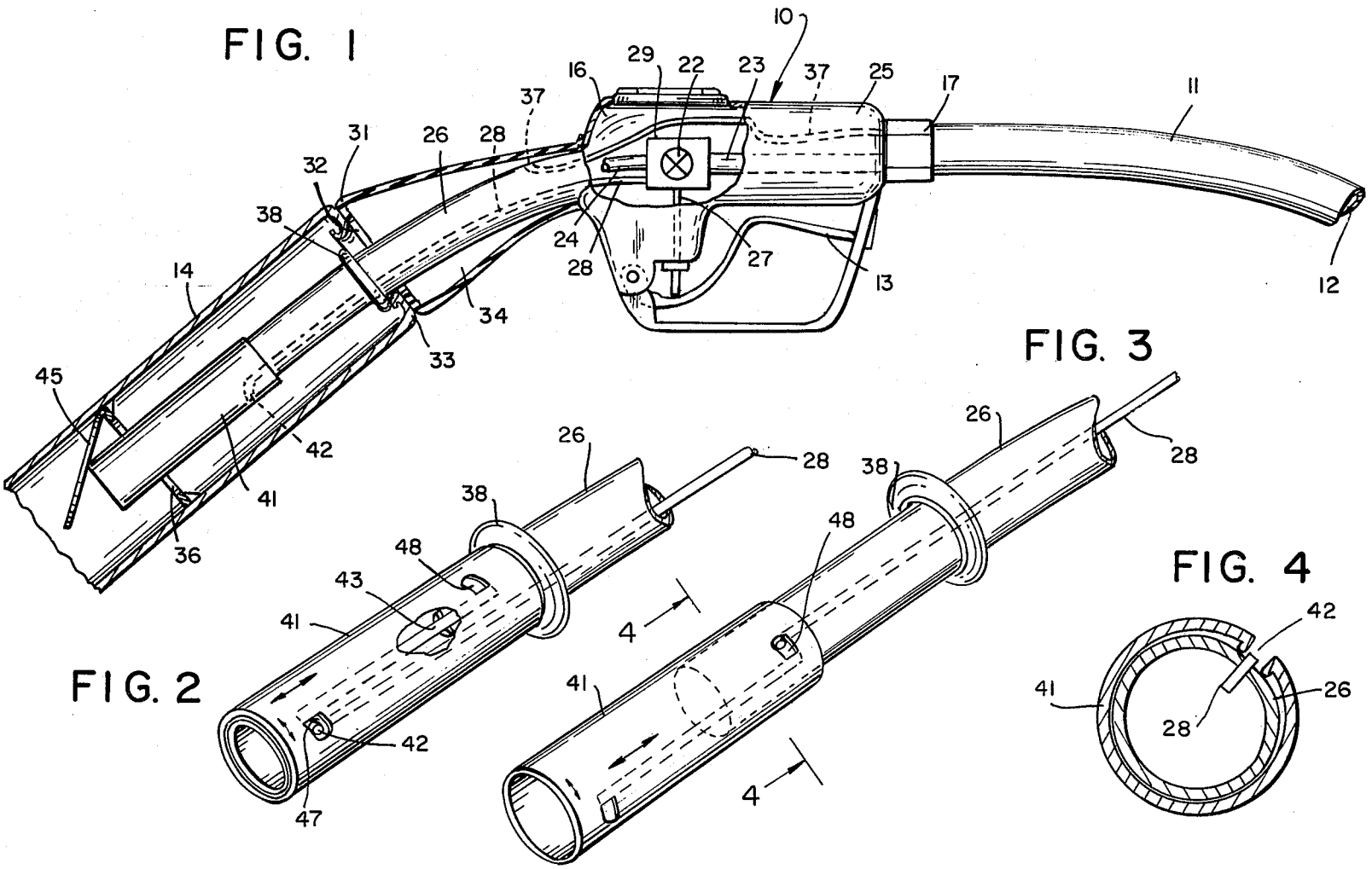
FIG. 1 is a vertical elevation view in partial cross section, of a fuel dispensing nozzle.
FIG. 2 is a segmentary view on an enlarged scale of the nozzle discharge end.
FIG. 3 is similar to FIG. 2.
FIG. 4 is a cross section view taken along line 4—4 in FIG. 3.

Nozzle 10 as in the instance of most nozzles for this purpose, also embodies the feature of being manually adjusted to commence flow by an actuating lever 13. However, as the level of fuel rises to the upper end of the tank filler tube 14, the nozzle will be automatically prompted to discontinue the flow.

Nozzle 10 as shown, comprises a body 16 having at one end a coupling 17 adapted to operably engage fuel conduit 11. The latter as noted, will ordinarily extend from the nozzle to a fuel pump or fuel source 12, and be of sufficient length to be movable about the pump to engage a vehicle tank to be filled.

Nozzle 10 is provided with a handle 21 which houses a main flow control valve 22. The latter, although shown schematically, is positioned with its upstream side communicated with the fuel conduit 11 through a passage 23 aligned longitudinally in handle 21. The downstream side of control valve 22 is communicated through an elongated passage 24 to the nozzle discharge tube 26. The latter depends from body 16 and is normally slightly curved at its upper end to more efficiently be accommodated within the fuel tank filler pipe 14. However, as shown, the lower end of discharge tube 26 is maintained relatively straight for the purpose to be hereinafter noted.

Nozzle 10 is further provided with manually operated actuating lever 13 which is pivoted at one end, and displaceable at the other end by hand pressure. An actuating pin 27 which is connected to the main flow control valve 22, has one portion thereof extending downwardly to engage the actuating lever 13. Thus, upon upward displacement of the latter, main flow control valve 22 will be normally opened. This will institute a flow of fuel through the valve under fuel pump pressure.

As previously noted, means is provided in the nozzle 10 for automatically discontinuing fuel flow when the vehicle tank becomes filled. Said means is well known in the art and is shown in FIG. 1 as comprising essentially a sensing conduit 28 positioned within discharge tube 26. The end of conduit 28 is open at its lower end to permit free passage of vapor therethrough.

Conduit 28 is further communicated with a pressure sensitive valve actuator shown schematically at actuating box 29. The latter is in turn connected to the main flow control valve 22 to discontinue flow through the latter when a particular signal is registered, or condition is achieved within the nozzle.

Operationally, as fuel within filler pipe 14 rises beyond the tip of the sensing conduit 28 a vapor flow condition normally maintained within said conduit 28 is upset causing a vacuum signal to be transmitted to the valve actuating mechanism 29. The latter, in response to the signal, causes the main fuel flow valve 22 to be displaced, thereby permitting the spring biased valve 22 to close and discontinue flow.

Nozzle 10 is further provided with a flexible walled elongated member 31, generally a cylindrical boot or bellows, which is connected at one end to the nozzle body 16. The other end is sufficiently large to define an opening larger than the diameter of discharge tube 26. The flexible member 31, which as noted can be a rubber boot, bellows, or the like, includes a resilient remote end 32. The latter is adapted to be forcibly urged into contact with the upper lip 33 of the gas tank filler pipe 14.

The fluid tight annular connection thus formed intermediate boot 32 and filler pipe 14, defines a leak-proof seal for vapors which are displaced from the vehicle fuel tank. Normally, during a fueling operation, the fuel vapors, as well as air, will be progressively displaced from the tank as the liquid fuel level rises.

Said vapors will pass upwardly through annular passage 34. Their normal routing will be to pass baffle plate 36, enter the upper portion of filler pipe 14, and proceed into the annular passage 34 within the rubber boot 31. The latter is communicated through the vapor return passage 37 formed in the nozzle handle 21, to be carried either through the fuel conduit 11 or through a separate pipe to an ultimate point of disposal.

The nozzle 10 as shown, is provided with a positioning or locking ring 38 depending from the outer surface discharge tube 26 and spaced rearwardly of the discharge tube open end. Said ring 38 is of such diameter that as the nozzle 10 is forcibly urged into the filler pipe 14 against resistance of rubber boot 31, the positioning ring will fall into place behind filler pipe lip 33. Thereafter the resiliency of the rubber boot 31 will maintain the nozzle in sealed, fuel transfer position.

The lower end of discharge tube 26 is provided with a sleeve or tubular extension 41 having a diameter slightly larger than the outer diameter of the said discharge tube. Sleeve 41 is preferably guidably slidable along the outer surface of the nozzle tube 26. The sleeve can thereby be movably positioned either in a retracted or extended position.

In the retracted position as shown in FIG. 2, discharge tube 26 is of ordinary length. Sleeve 41 is maintained in its retracted position by engagement therewith of an upstanding guide member 42 which is received in a guide channel 43, which in turn depends from the inner surface of tube 26. Guide member 42 comprises the lower end of pressure sensing conduit 28. The latter as shown, is exposed to the atmosphere by an opening 46 formed through the wall of sleeve 41.

Guide channel 43 includes an elongated channel formed longitudinally of the inner side of the sleeve 41, which channel is communicated directly with a first cross guide channel 47. Thus, by rotating sleeve 41 to move guide 42 from first channel 47 to guide channel 43, the sleeve can be extended longitudinally of the discharge tube 26. Upon further rotation, the sleeve becomes locked into its desired extended arrangement within second cross channel 48. In such position, and referring to FIG. 1, the remote end of sleeve 41 is free to register within aperture 49 formed in the baffle 36 and is there maintained by friction. When so positioned, it displaces hinged closure member 45.

As herein mentioned, main guide channel 43 is provided with first and second cross branches 47 and 48. Each of said channels is provided with openings formed therein to communicate with the open tip of the sensing tube 28. Thus, in either withdrawn or extended position, sensing tube 28 is communicated with the atmosphere within filler pipe 14 so that it will sense the condition therein. Said sensing tube will thereby function in the desired manner by triggering the fuel cutoff when the tank becomes filled.

For a normal fuel transfer operation where it is determined by the operator that the filler pipe baffle 36 is deep set within the filler pipe 14, the operator will manually rotate sleeve 41 and extend it forward along tube 26. A second rotative movement of the sleeve will fix the latter in its extended position. Thereafter, insertion of the nozzle 10 into the filler tube 14 will be guided by the positioning of the lower end of the sleeve within the baffle aperture to register in the latter and to displace closure member 45.

Simultaneously, the operation will exert enough inserting force on the nozzle 10 to deform the rubber boot 31 until the positioning ring 38 registers within the opening defined by filler pipe lip 33. By depressing the nozzle a slight amount, the positioning ring 38 is brought into abutment with an inner portion of the lip 33 such that the nozzle is now maintained in place. Thereafter, displacement of actuating lever 13 will institute fuel flow as herein noted until the fuel rises within the filler pipe 14, and the shutting off mechanism is set into motion.

Other modifications and variations of the invention as hereinbefore set forth may be made without departing from the spirit and scope thereof, and therefore, only such limitations should be imposed as are indicated in the appended claims.

I claim:

1. A fuel dispensing nozzle having a discharge tube adapted to sealably engage the filler pipe of a tank to be filled, said discharge tube including a liquid level sensing means positioned therein and having an elongated sensing conduit (28) with a sensing end thereof disposed adjacent to the discharge tube open end, said sensing conduit being communicated with a pressure sensitive element in said nozzle capable of automatically discontinuing fuel flow through the nozzle when fuel in the filler pipe rises a sufficient distance to cover said sensing conduit end, said filler pipe including a baffle plate disposed transversely thereof, and means forming an aperture in said baffle plate sufficiently large to register the remote end of a discharge tube therethrough, the improvement in said nozzle to allow introduction of fuel into said filler pipe at a point downstream of said baffle plate which comprises;

a discharge tube extension sleeve longitudinally slidably carried on the external surface of said discharge tube and having guide means on the inner surface thereof, and being adapted to be adjusted on said discharge tube between extended and retracted positions, whereby in the extended position said extension sleeve will register within said baffle plate aperture to permit the introduction of a flow of fuel into said tank without said fuel accumulating upstream of the baffle plate prior to the tank becoming filled, said end of said sensing tube traversing a wall of said discharge tube, and having sliding engagement with said extension sleeve guide means to guidably regulate movement of the sleeve between the extended and retracted positions thereof.

2. In an apparatus as defined in claim 1, including a positioning ring carried on said discharge tube at a point rearward of said extension tube and adapted to engage said filler pipe for properly positioning said nozzle.

3. In an apparatus as defined in claim 1, wherein said discharge tube extension sleeve is rotatably longitudinally slidable along said discharge tube while in guided contact with said sensing conduit (28).

4. In an apparatus as defined in claim 1, wherein said discharge tube extension sleeve is disposed substantially concentric with said discharge tube.

* * * * *